US012504168B2

(12) United States Patent
Nath et al.

(10) Patent No.: US 12,504,168 B2
(45) Date of Patent: Dec. 23, 2025

(54) COWL DAMPER FOR COMBUSTOR

(71) Applicant: General Electric Company, Schenectady, NY (US)

(72) Inventors: Hiranya Nath, Bengaluru (IN); Ravindra Shankar Ganiger, Bengaluru (IN); Sripathi Mohan, Bengaluru (IN); Perumallu Vukanti, Bangalore (IN); Kwanwoo Kim, Cincinnati, OH (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/314,414

(22) Filed: May 9, 2023

(65) Prior Publication Data

US 2024/0133555 A1 Apr. 25, 2024
US 2024/0230099 A9 Jul. 11, 2024

(30) Foreign Application Priority Data

Oct. 20, 2022 (IN) ..... 202211060134

(51) Int. Cl.
*F23R 3/00* (2006.01)
*F23R 3/42* (2006.01)

(52) U.S. Cl.
CPC ..... *F23R 3/002* (2013.01); *F23R 3/42* (2013.01); *F23R 2900/00014* (2013.01)

(58) Field of Classification Search
CPC .. F23R 3/002; F23R 3/50; F23R 2900/00014; F23R 2900/03041; F23R 2900/03042; F05D 2260/963; F23M 20/005
See application file for complete search history.

(56) References Cited

U.S. PATENT DOCUMENTS

| | | | | |
|---|---|---|---|---|
| 4,232,527 | A | 11/1980 | Reider | |
| 6,148,600 | A | 11/2000 | Farmer et al. | |
| 6,351,947 | B1 * | 3/2002 | Keller | F23M 20/005 60/725 |
| 6,678,953 | B2 | 1/2004 | Thompson et al. | |
| 7,805,943 | B2 | 10/2010 | Desaulty et al. | |
| 8,127,546 | B2 | 3/2012 | Park | |
| 8,677,757 | B2 * | 3/2014 | Sadig | F23M 20/005 60/725 |
| 8,720,204 | B2 * | 5/2014 | Schilp | F23R 3/06 60/725 |
| 9,188,342 | B2 * | 11/2015 | Melton | F23R 3/286 |
| 9,395,082 | B2 * | 7/2016 | Tiwary | F23R 3/06 |
| 9,447,970 | B2 * | 9/2016 | Kim | F23R 3/002 |
| 10,101,031 | B2 | 10/2018 | Williams et al. | |

(Continued)

FOREIGN PATENT DOCUMENTS

| | | |
|---|---|---|
| EP | 3431875 B1 | 12/2020 |
| FR | 2974162 B1 | 4/2018 |

(Continued)

*Primary Examiner* — Alain Chau
(74) *Attorney, Agent, or Firm* — Venable LLP; Griffin A. A. Deadwick; Michele V. Frank

(57) ABSTRACT

A combustor for a turbomachine engine. The combustor includes a combustion chamber, and a cowl having an annular shape that is symmetric around a centerline axis of the turbomachine engine. The cowl includes a hollow cavity that is in fluid communication with the combustion chamber. The hollow cavity is a damper that reduces combustion dynamics of the combustor.

20 Claims, 10 Drawing Sheets

(56) References Cited

U.S. PATENT DOCUMENTS

| | | | | |
|---|---|---|---|---|
| 10,359,194 | B2 * | 7/2019 | Schilp | F23R 3/002 |
| 10,527,284 | B2 | 1/2020 | Sobol et al. | |
| 10,634,350 | B2 | 4/2020 | Harding et al. | |
| 10,724,739 | B2 * | 7/2020 | Kim | F23R 3/002 |
| 10,935,242 | B2 | 3/2021 | Marusko et al. | |
| 10,941,939 | B2 | 3/2021 | Graham et al. | |
| 10,982,852 | B2 | 4/2021 | Sauer et al. | |
| 11,022,309 | B2 * | 6/2021 | Roh | F23R 3/286 |
| 2011/0005233 | A1 * | 1/2011 | Sadig | F23M 20/005 60/754 |
| 2012/0073306 | A1 * | 3/2012 | Habarou | F23R 3/002 60/796 |
| 2013/0042627 | A1 * | 2/2013 | Gerendas | F23M 20/005 60/725 |
| 2017/0009986 | A1 * | 1/2017 | Patel | F23R 3/60 |
| 2017/0058780 | A1 * | 3/2017 | Kim | F02C 9/18 |
| 2018/0274780 | A1 * | 9/2018 | Kim | F23R 3/10 |
| 2018/0347468 | A1 | 12/2018 | Caimano et al. | |
| 2019/0017441 | A1 * | 1/2019 | Venkatesan | F23R 3/002 |
| 2019/0024894 | A1 | 1/2019 | Mongillo et al. | |
| 2019/0101289 | A1 | 4/2019 | Mongillo, Jr. et al. | |
| 2021/0341150 | A1 * | 11/2021 | Matsuyama | F23R 3/14 |
| 2022/0282870 | A1 * | 9/2022 | Kim | F23R 3/286 |

FOREIGN PATENT DOCUMENTS

| | | | |
|---|---|---|---|
| FR | 3050229 | B1 | 4/2018 |
| WO | 2020136359 | A1 | 7/2020 |

* cited by examiner

COWL DAMPER FOR COMBUSTOR

CROSS REFERENCE TO RELATED APPLICATIONS

The present application claims the benefit of Indian Patent Application No. 202211060134, filed on Oct. 20, 2022, which is hereby incorporated by reference herein in its entirety.

TECHNICAL FIELD

The present disclosure relates to a cowl damper for a combustor of turbomachine engines.

BACKGROUND

Combustors in turbomachine engines receive a mixture of fuel and highly compressed air, which is ignited to produce hot combustion gases. These hot gases are used to provide a torque in a turbine to provide mechanical power and thrust. Continuing demands for increased engine performance (e.g., higher cycle overall pressure ratio) and fuel efficiency (e.g., lower specific fuel consumption) pose a contradicting challenge to meet environmental requirements for acoustic noise and emissions, versus economic requirements for longer combustor component life cycles.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Figure 1:
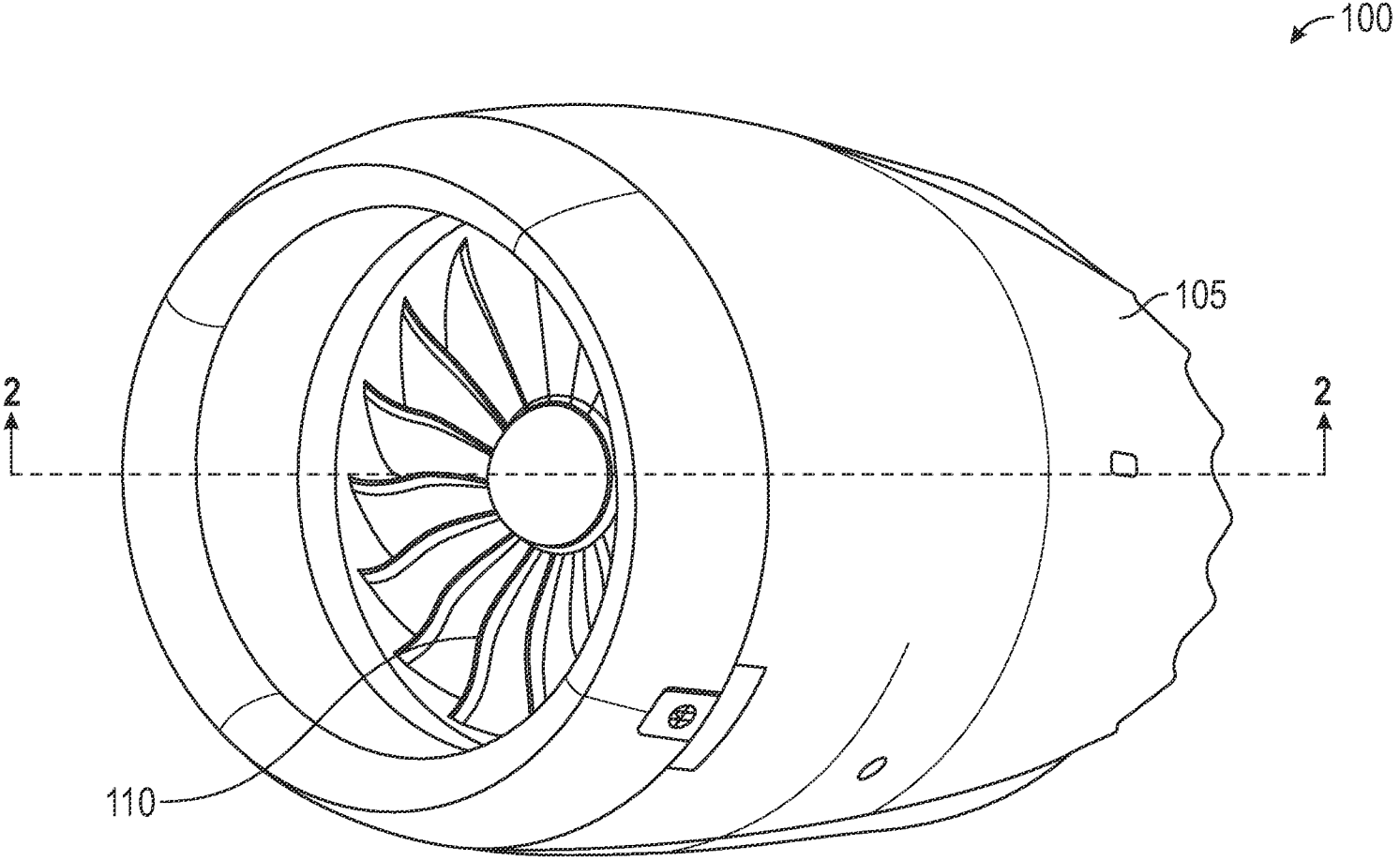
FIG. 1 shows an example of a turbomachine engine, according to an embodiment of the present disclosure.

Features, advantages, and embodiments of the present disclosure are set forth or apparent from a consideration of the following detailed description, drawings, and claims. Moreover, it is to be understood that the following detailed description are exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and scope of the present disclosure.

As used herein, the terms "first," "second," and "third" may be used interchangeably to distinguish one component from another and are not intended to signify location or importance of the individual components.

The terms "fore" (or "forward") and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

The terms "outer" and "inner" refer to relative positions within a turbomachine engine, from a centerline axis of the engine. For example, outer refers to a position further from the centerline axis and inner refers to a position closer to the centerline axis.

The terms "coupled," "fixed," "attached to," and the like, refer to both direct coupling, fixing, or attaching, as well as indirect coupling, fixing, or attaching through one or more intermediate components or features, unless otherwise specified herein.

The term "propulsive system" refers generally to a thrust-producing system, which thrust is produced by a propulsor, and the propulsor provides the thrust using an electrically-powered motor(s), a heat engine such as a turbomachine, or a combination of electrical motor(s) and a turbomachine.

The singular forms "a," "an," and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a one, two, four, ten, fifteen, or twenty percent margin in either individual values, range(s) of values, and/or endpoints defining range(s) of values.

The terms "low" and "high," or their respective comparative degrees (e.g., "lower" and "higher", where applicable), when used with the compressor, turbine, shaft, or spool components, each refers to relative pressures and/or relative speeds within an engine unless otherwise specified. For example, a "low-speed shaft" defines a component configured to operate at a rotational speed, such as a maximum allowable rotational speed, which is lower than that of a "high-speed shaft" of the engine. Alternatively, unless otherwise specified, the aforementioned terms may be understood in their superlative degree. For example, a "low-pressure turbine" may refer to the lowest maximum pressure within a turbine section, and a "high-pressure turbine" may refer to the highest maximum pressure within the turbine section. The terms "low" or "high" may additionally, or alternatively, be understood as relative to minimum allowable speeds and/or pressures, or minimum or maximum allowable speeds and/or pressures relative to normal, desired, steady state, etc., operation.

One or more components of the turbomachine engine described below may be manufactured or formed using any suitable process, such as an additive manufacturing process, such as a three-dimensional (3D) printing process. The use of such a process may allow such a component to be formed integrally, as a single monolithic component, or as any suitable number of sub-components. In particular, the additive manufacturing process may allow such a component to be integrally formed and include a variety of features not possible when using prior manufacturing methods. For example, the additive manufacturing methods described herein enable the manufacture of combustor cowls having unique features, configurations, thicknesses, materials, densities, passageways, headers, and mounting structures that may not have been possible or practical using prior manufacturing methods. Some of these features are described below.

This disclosure and various embodiments relate to a turbomachine engine, also referred to as a gas turbine engine, a turboprop engine, or a turbomachine. These turbomachine engines can be applied across various technologies and industries. Various embodiments may be described herein in the context of aeronautical engines and aircraft machinery.

In some instances, a turbomachine engine is configured as a direct drive engine. In other instances, a turbomachine engine can be configured as a geared engine with a gearbox. In some instances, a propulsor of a turbomachine engine can be a fan encased within a fan case and/or a nacelle. This type of turbomachine engine can be referred to as "a ducted engine." In other instances, a propulsor of a turbomachine engine can be exposed (e.g., not within a fan case or a nacelle). This type of turbomachine engine can be referred to as "an open rotor engine" or an "unducted engine."

FIG. 1 shows an example of a turbomachine engine 100, according to an embodiment of the present disclosure. Types of such engines include turboprops, turbofans, turbomachines, and turbojets. The turbomachine engine 100 is a ducted engine covered by a protective cowl 105, so that the only component visible in this exterior view is a fan assembly 110. A nozzle, not visible in FIG. 1, also protrudes from the aft end of the turbomachine engine 100 beyond the protective cowl 105.

Figure 2:
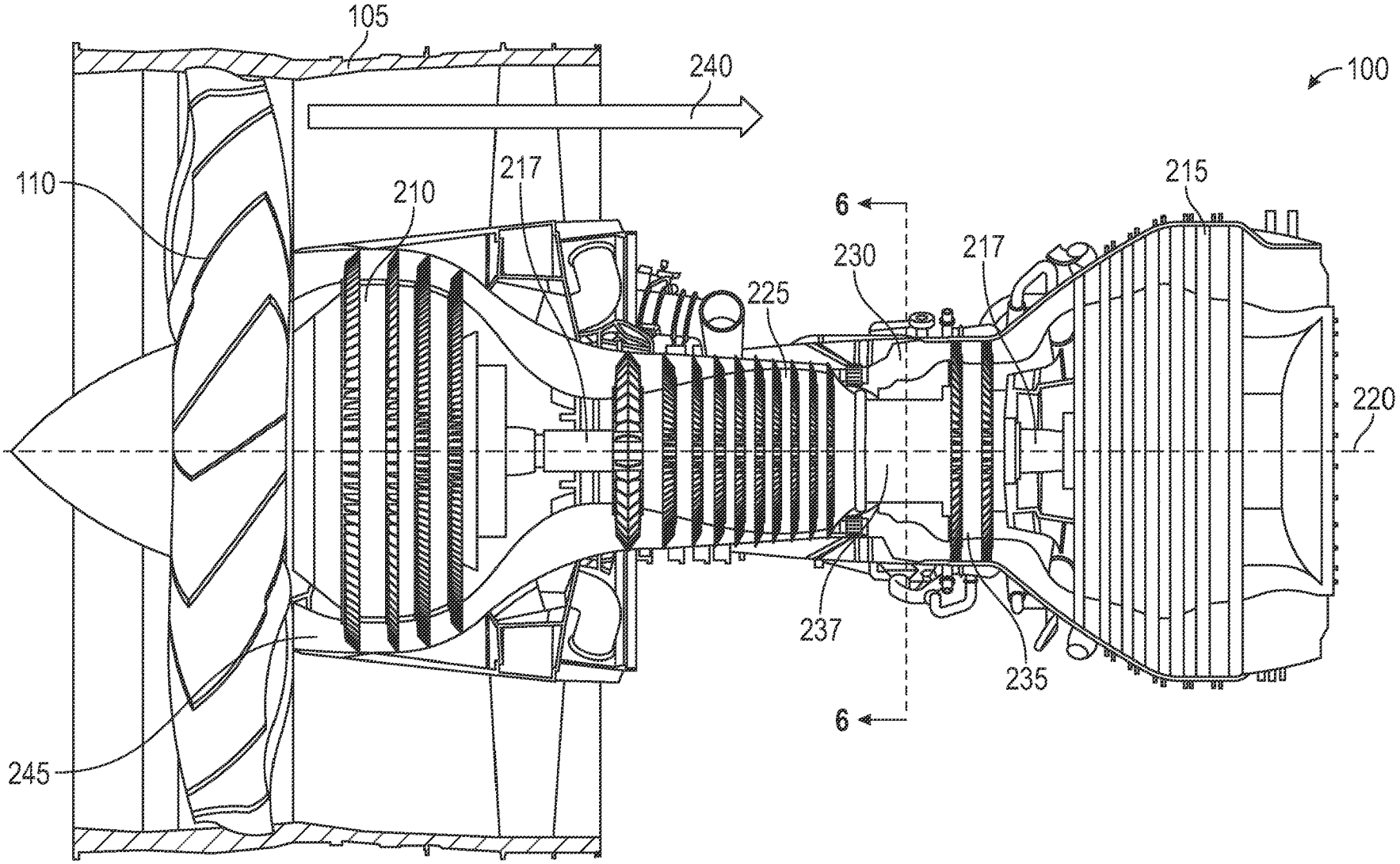
FIG. 2 shows a schematic, cross-sectional view taken along line 2-2 of the turbomachine engine shown in FIG. 1.

FIG. 2 shows a schematic, cross-sectional view taken along line 2-2, of the turbomachine engine 100 shown in FIG. 1, which may incorporate one or more embodiments of the present disclosure. In this example, the turbomachine engine 100 is a two-spool turbomachine that includes a high-speed system and a low-speed system, both of which are fully covered by the protective cowl 105. The low-speed system of the turbomachine engine 100 includes the fan assembly 110, a low-pressure compressor 210 (also referred to as a booster), and a low-pressure turbine 215, all of which are coupled to a low-pressure shaft 217 (also referred to as the low-pressure spool) that extends between the low-speed system components along the centerline axis 220 of the turbomachine engine 100. The low-pressure shaft 217 enables the fan assembly 110, the low-pressure compressor 210, and the low-pressure turbine 215 to rotate in unison about the centerline axis 220.

The high-speed system of the turbomachine engine 100 includes a high-pressure compressor 225, a combustor 230, and a high-pressure turbine 235, all of which are coupled to a high-pressure shaft 237 that extends between the high-speed system components along the centerline axis 220 of the turbomachine engine 100. The high-pressure shaft 237 enables the high-pressure compressor 225 and the high-pressure turbine 235 to rotate in unison about the centerline axis 220, at a different rotational speed than the rotation of the low-pressure components (and, in some embodiments, at a higher rotational speed, and/or a counter-rotating direction, relative to the low-pressure system).

The components of the low-pressure system and the high-pressure system are positioned so that a portion of the air taken in by the turbomachine engine 100 flows through the turbomachine engine 100 in a flow path from fore to aft through the fan assembly 110, the low-pressure compressor 210, the high-pressure compressor 225, the combustor 230, the high-pressure turbine 235, and the low-pressure turbine 215. Another portion of the air intake by the turbomachine engine 100 bypasses the low-pressure system and the high-pressure system, and flows from fore to aft as shown by arrow 240.

This portion of air entering the flow path of the turbomachine engine 100 is supplied from an inlet 245. For the embodiment shown in FIG. 2, the inlet 245 has an annular or an axisymmetric three hundred sixty-degree configuration, and provides a path for incoming atmospheric air to enter the turbomachinery flow path, as described above. Such a location may be advantageous for a variety of reasons, including management of icing performance as well as protecting the inlet 245 from various objects and materials as may be encountered in operation. In other embodiments, however, the inlet 245 may be positioned at any other suitable location, e.g., arranged in a non-axisymmetric configuration.

The combustor 230 is located between the high-pressure compressor 225 and the high-pressure turbine 235. The combustor 230 can include one or more configurations for receiving a mixture of fuel from a fuel system (not shown in FIG. 2) and air from the high-pressure compressor 225. This mixture is ignited by an ignition system (not shown in FIG. 2), creating hot combustion gases that flow from fore to aft through the high-pressure turbine 235, which provides a torque to rotate the high-pressure shaft 237 and, thereby, to rotate the high-pressure compressor 225. After exiting the high-pressure turbine, the combustion gases continue to flow from fore to aft through the low-pressure turbine 215, which provides a torque to rotate the low-pressure shaft 217 and, thereby, to rotate the low-pressure compressor 210 and the fan assembly 110.

In other words, the forward stages of the turbomachine engine 100, namely, the fan assembly 110, the low-pressure compressor 210, and the high-pressure compressor 225, all prepare the intake air for ignition. The forward stages all require power in order to rotate. The rear stages of the turbomachine engine 100, namely, the combustor 230, the high-pressure turbine 235, and the low-pressure turbine 215, provide that requisite power, by igniting the compressed air and using the resulting hot combustion gases to rotate the low-pressure shaft 217 and the high-pressure shaft 237 (also referred to as rotors). In this manner, the rear stages use air to physically drive the front stages, and the front stages are driven to provide air to the rear stages.

As the exhaust gas exits out of the aft end of the rear stages, the exhaust gas reaches the nozzle at the aft end of the turbomachine engine 100 (not shown in FIG. 2). When the exhaust gases pass over the nozzle, and combine with the bypassed air that is also being driven by the fan assembly 110, an exhaust force is created that is the thrust generated by the turbomachine engine 100. This thrust propels the turbomachine engine 100, and, for example, an aircraft to which it may be mounted, in the forward direction.

As in the embodiment shown in FIG. 2, the fan assembly 110 is located forward of the low-pressure turbine 215 in a "puller" configuration, and the exhaust nozzle is located aft. As is depicted, the fan assembly 110 is driven by the low-pressure turbine 215, and, more specifically, is driven by the low-pressure shaft 217. More specifically, the turbomachine engine 100 in the embodiment shown in FIG. 2 includes a power gearbox (not shown in FIG. 2), and the fan assembly 110 is driven by the low-pressure shaft 217 across the power gearbox. The power gearbox may include a gearset for decreasing a rotational speed of the low-pressure shaft 217 relative to the low-pressure turbine 215, such that the fan assembly 110 may rotate at a slower rotational speed than does the low-pressure shaft 217. Other configurations are possible and contemplated within the scope of the present disclosure, such as what may be termed a "pusher" configuration embodiment in which the low-pressure turbine 215 is located forward of the fan assembly 110.

The turbomachine engine 100 depicted in FIGS. 1 and 2 is by way of example only. In other embodiments, the turbomachine engine 100 may have any other suitable configuration, including, for example, any other suitable number of shafts or spools, fan blades, turbines, compressors, etc., and the power gearbox may have any suitable configuration, including, for example, a star gear configuration, a planet gear configuration, a single-stage, a multi-stage, epicyclic, non-epicyclic, etc. The fan assembly 110 may be any suitable fixed-pitched assembly or variable-pitched assembly. The turbomachine engine 100 may include additional components not shown in FIGS. 1 and 2, such as vane assemblies and/or guide vanes, etc.

Figure 3:
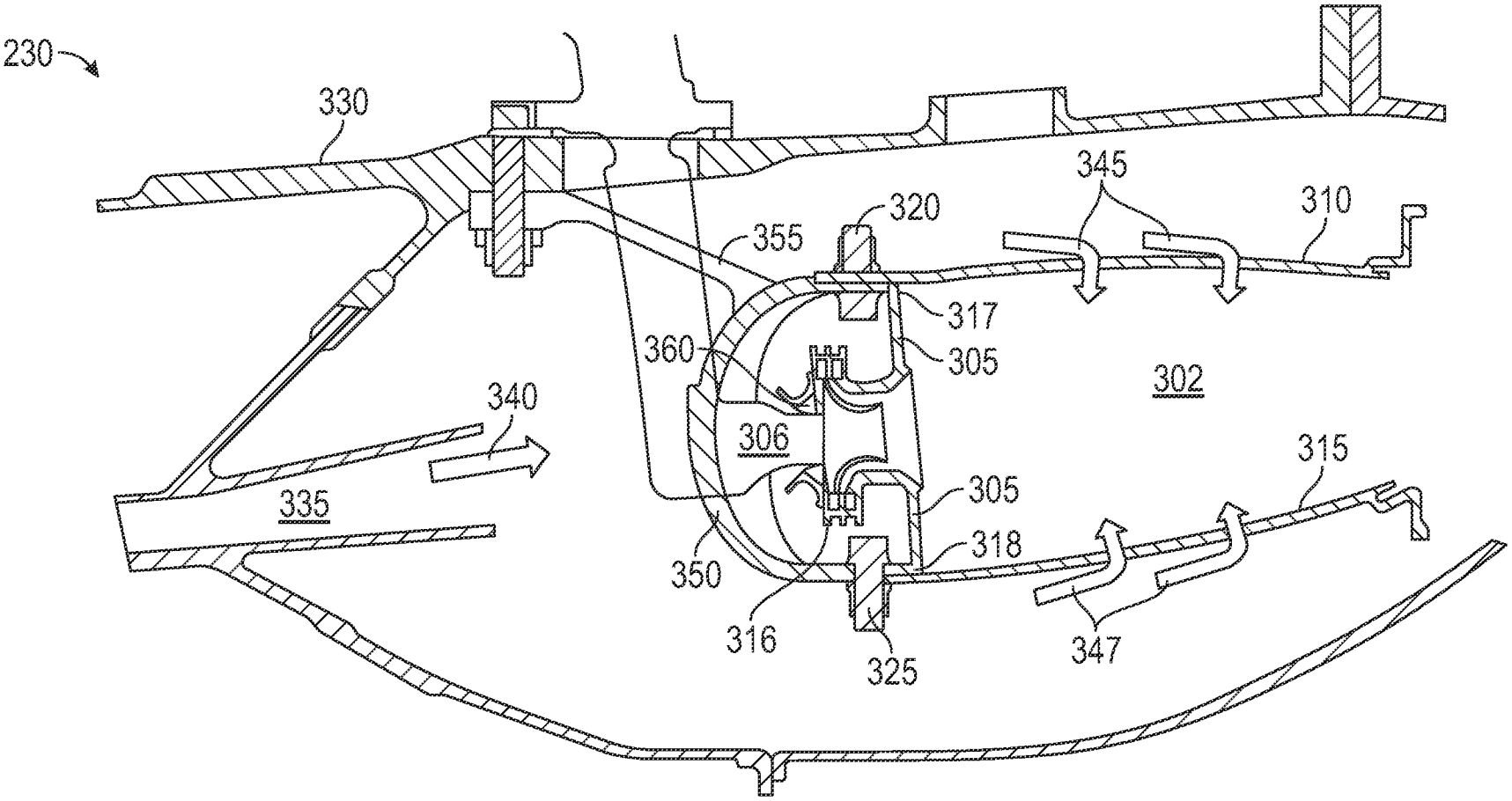
FIG. 3 shows a schematic view of the combustor of the turbomachine engine.

FIG. 3 shows a schematic view of the combustor 230 of the turbomachine engine 100. The combustion chamber 302 of the combustor 230 is an annular open space with axial symmetry around the centerline axis 220 (FIG. 2). The combustion chamber 302 is bounded at the forward end by a dome 305. The combustor 230 also has an annular ring of fuel nozzles 306 spaced along the circumference (also referred to as the circumferential direction) and facing in the aft direction. The dome 305 supports and positions each fuel nozzle 306, as well as an outer liner 310 and an inner liner 315 on the outer and inner annular surfaces, respectively. The outer liner 310 and the inner liner 315 are coaxial cylindrical surfaces around the centerline axis 220, the outer liner 310 being spaced radially outward from the inner liner 315.

Compressed air from the front stages of the turbomachine engine 100 flows into the combustor 230 and mixes in the combustion chamber 302 with fuel from the fuel nozzles 306. Each fuel nozzle 306 delivers fuel into a separate region (referred to as a cup) of the total annular volume of the combustion chamber 302, in accordance with a desired performance of the combustor 230 at various engine operating states. The air enters the combustion chamber 302 from swirlers 316 that surround each fuel nozzle 306, as well as through cooling holes (not shown in FIG. 3) in the inner liner 315 and the outer liner 310. The fuel-air mixture is ignited in the combustion chamber 302 to produce a steady flow of combustion gases that enter the turbines in the rear stages.

The dome 305 is oriented perpendicular to the central axes of the swirlers 316 and is symmetric around the centerline axis 220, with openings spaced along the circumference to receive each fuel nozzle 306. Because of its proximity to the combustion chamber, hot gases, and the extreme temperatures produced therein, the dome 305 must be configured to withstand a harsh environment. The combustion chamber 302 is open in the aft direction, to allow combustion gases to flow towards the high-pressure turbine 235 (FIG. 2).

The outer liner 310 and the inner liner 315 have a cylindrical shape with rotational symmetry around the centerline axis 220 (FIG. 2), the outer liner 310 having a radius greater than that of the inner liner 315. Both the outer liner 310 and the inner liner 315 extend in the aft direction along the centerline axis 220, with cooling holes along their surface to allow additional air from the high-pressure compressor 225 (FIG. 2) to mix with the fuel in the combustion chamber 302. Each liner has a cold side, which is the surface outside the combustion chamber 302 through which air enters the cooling holes, and a hot side, which is the surface inside the combustion chamber 302 through which air exits the cooling holes.

In the example of FIG. 3, the dome 305, the outer liner 310, and the inner liner 315 are all made of metal, though in some embodiments at least portions of the outer liner 310 and the inner liner 315 may alternatively be made of ceramic matrix composite materials. The liners may include integrally joined portions that are mechanically joined using an overlapping portion according to one embodiment. In other embodiments, the liners are formed in an additive manufacturing process as one unitary body.

The dome 305 and the outer liner 310 are coupled together at an outer wall 317 of the dome 305, and the dome 305 and the inner liner 315 are coupled together at an inner wall 318 of the dome 305 with arrays 320, 325 of fasteners. The fasteners in the arrays 320, 325 may include one or more of pins, bolts, nuts, nut plates, screws, and any other suitable types of fasteners. The arrays 320, 325 also serve to couple the dome 305, the outer liner 310, and the inner liner 315 to a support structure 330 of the combustor 230.

The support structure 330 defines a diffuser 335 which is an inlet for compressed air to flow from the high-pressure compressor 225 (FIG. 2), from fore to aft as shown by arrow 340, and into the combustion chamber 302 through the swirler 316 positioned around the fuel nozzle 306. The air also flows into the combustion chamber 302 through dilution holes (not shown in FIG. 3) in the outer liner 310 (e.g., along arrows 345) and through dilution holes (not shown in FIG. 3) in the inner liner 315 (e.g., along arrows 347). In addition, one or more heat shields and/or deflectors (not shown in FIG. 3) may also be provided on the dome 305 to help to protect the dome 305 from the heat of the combustion gases.

In addition, the support structure 330 supports the dome 305 with a cowl 350, the cowl 350 being connected to the support structure 330 by a mounting arm 355. The cowl 350 has an annular shape that is symmetric about the centerline axis 220, an aft-facing channel to receive the dome 305, and a forward-facing aperture to receive the fuel nozzle 306. The cowl 350 may be a single piece design, as shown in FIG. 3, having multiple openings around the circumference to receive each fuel nozzle 306. Alternatively, the cowl 350 may be a two-piece design or a split-cowl design, with an inner cowl (not shown in FIG. 3) and an outer cowl (not shown in FIG. 3), each having an annular shape that is symmetric about the centerline axis 220, and positioned to define a gap between them through which each fuel nozzle 306 may extend towards the combustion chamber 302.

The cowl 350 is coupled directly to the outer wall 317 and the inner wall 318 of the dome 305 by the arrays 320, 325 of fasteners. The cowl 350 may distribute the airflow aerodynamically between the dome 305 and the swirler 316 and around the inner liner 315 and the outer liner 310 surrounding the combustion chamber 302. A ferrule 360 is used to center the fuel nozzle 306 with the swirler 316. Other suitable structural configurations are contemplated.

The air flowing through the combustor 230 may generate an acoustic instability and/or a hydrodynamic instability in the combustion chamber 302 due to the flow therethrough. This instability is naturally occurring at one or more specific frequencies based on the dimensions and flow through the combustor 230. The hydrodynamic instability and/or the acoustic instability may generate fluctuations of pressure and velocity that may lead to combustion dynamics and durability issues in the combustor. In order to reduce or to eliminate the hydrodynamic and/or acoustic instability in the combustion chamber 302 (and, thus, eliminate or reduce the fluctuations in pressure and velocity), in some embodiments, a damper may be provided within a cavity within the cowl 350. The cowl damper may be sized and designed to exactly match or to closely match the frequency of the hydrodynamic instability to suppress, to reduce, and/or to eliminate the hydrodynamic instability in the combustion chamber 302. That is, the cowl damper may target a specific frequency of instability within the combustion chamber 302 and may be designed to counteract that specific frequency.

In some embodiments, the cowl 350 has a hollow cavity that is configured as a damper, to reduce combustion dynamics of the combustor. The hollow cowl can contain more than one damping volume to target multiple frequencies. The flow of air through the hollow cowl damper can also be used for supplemental or film cooling for the combustor liners.

Some advantages of the proposed hollow cowl damper include reducing engine noise and improving the durability of the combustor by reducing combustion dynamics and mechanical vibration. The simple and compact design also provides for a low cost of implementation. A hollow cowl damper also provides for repairability and serviceability, by being easier to retrofit to existing engines. The hollow cowl damper may be made using thinner sheet metal to have the same strength as solid cowl designs, resulting in a weight neutral or marginal weight addition, and is applicable to single piece architecture and two-piece cowl architecture.

In some embodiments, the hollow cowl damper is configured as a Helmholtz resonator, whose volume, neck length, and neck area are configured to dampen combustion dynamics for a particular frequency. In some embodiments, the hollow cowl damper has multiple cavities, and the individual cavities are independently tuned (e.g., by varying the volume, length, and area) to address a wide range of combustion dynamics frequencies, e.g., from one hundred eighty Hertz (Hz) to two thousand Hz in some embodiments. However, the maximum range can be extended beyond two thousand Hz by further tuning the design. As an example, in a two-piece cowl, the inner and outer cowl can be configured to address different ranges of frequencies, e.g., one hundred eighty to four hundred Hz for the inner cowl, and four hundred—one thousand Hz for the outer cowl (or vice versa). As another example, in either a single piece or a two-piece cowl design, adjacent cavities may be separately tuned for different frequency ranges, using baffles or internal partitions between the cavities.

The hollow cowl damper may have one or more metering holes through which air enters the acoustic cavity. Some embodiments may be configured with a dual air circuit, for acoustic feed holes and cooling holes, respectively. Partitions and/or baffles may be used to direct the cooling flow through the hollow cowl to act as a starting cooling film for liner multi-hole cooling.

Figure 4:
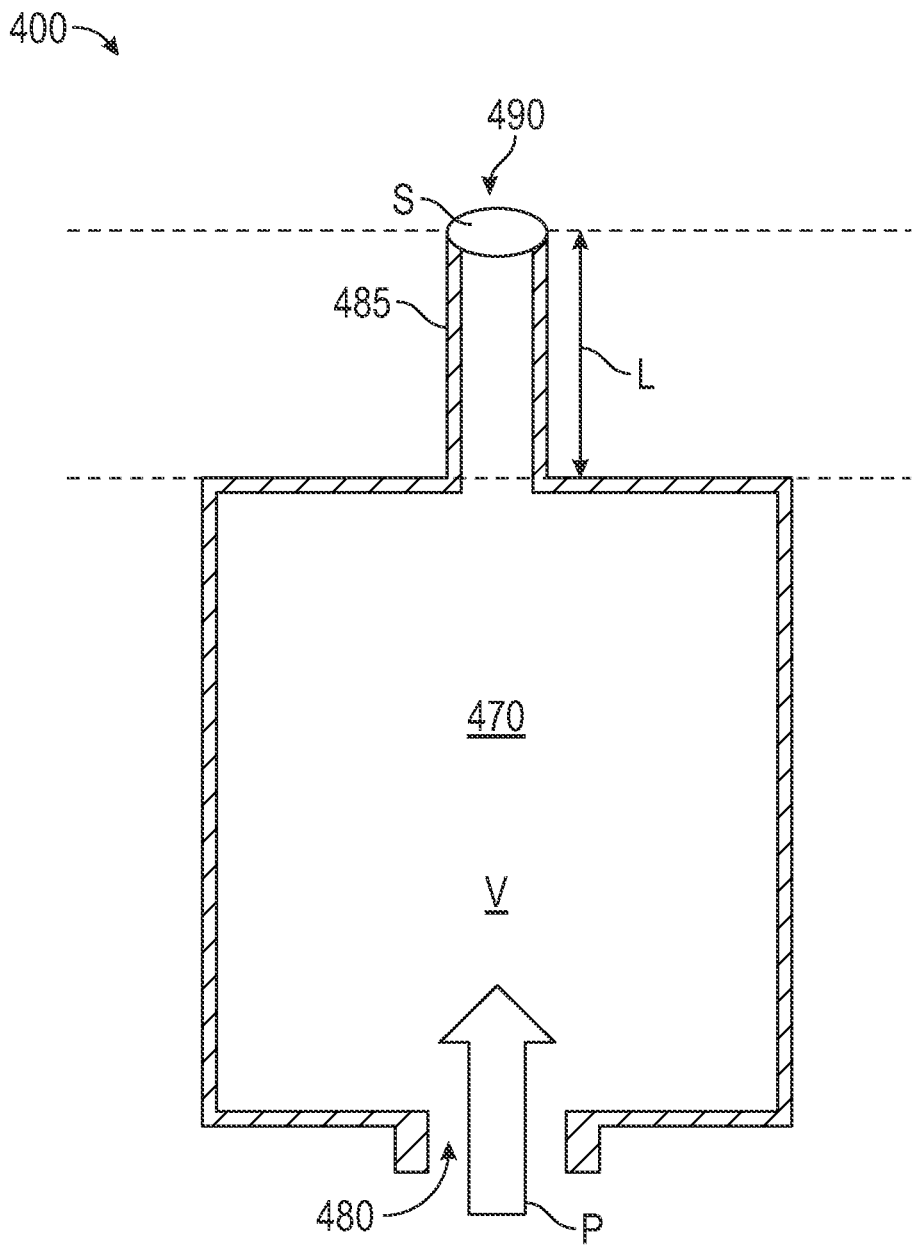
FIG. 4 depicts a schematic, conceptual view of a damper that is configured as a Helmholtz resonator to reduce combustion dynamics.

FIG. 4 depicts a schematic, conceptual view of a damper 400 that is configured as a Helmholtz resonator to reduce combustion dynamics. The damper 400 may include a cavity 470 having a volume V. The damper 400 may include a metering hole 480 that may allow air to flow into the cavity 470, as indicated by arrow P. The damper 400 may include a neck 485 between the cavity 470 and a neck opening 490. The neck opening 490 may have a cross-sectional area S and the neck 485 may have an effective length L. The resonant frequency of the damper 400 may be calculated as follows:

$$f = \frac{c}{2\pi}\sqrt{\frac{S}{VL}} \tag{1}$$

where c is the speed of sound, S is the cross-sectional area of the neck opening 490, V is the volume of the cavity 470, and L is the length of the neck 485. In examples with more than one neck opening 490, the area S may be the sum of all of the cross-sectional areas of the neck openings.

Figure 5:
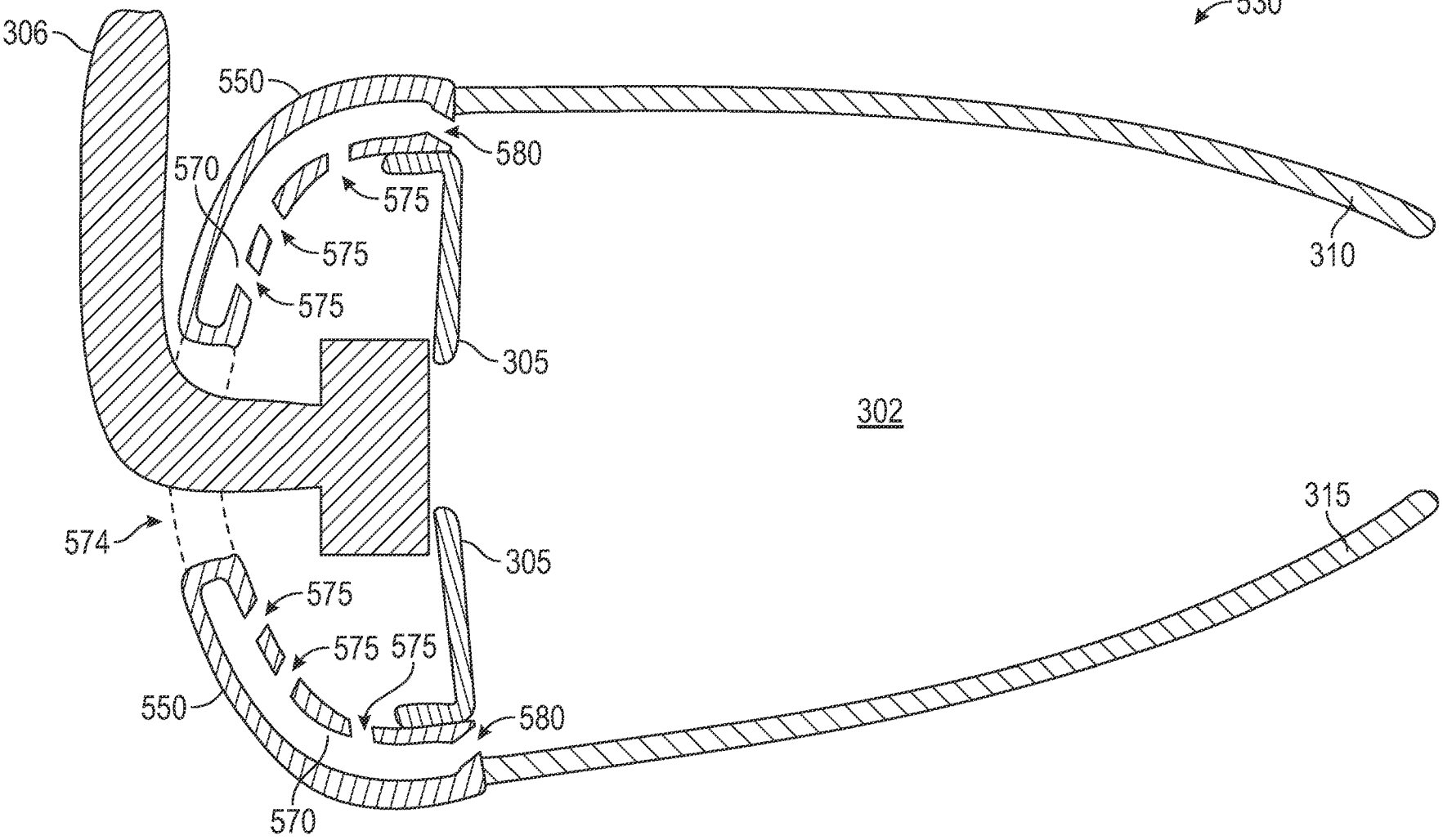
FIG. 5 shows a schematic view of a combustor of some embodiments having a single-piece cowl that has a cavity configured as a Helmholtz resonator for acoustic damping.

FIG. 5 shows a schematic view of a combustor 530 of some embodiments having a single-piece cowl 550 that has a cavity 570 configured as a Helmholtz resonator for acoustic damping. The view in FIG. 5 is through the midplane of a single cup of the combustor 530, along the axial length. The ferrule 360 and the swirler 316 have been omitted from FIG. 5 for clarity.

The cowl 550 has an annular shape that is symmetric around the centerline axis 220 (FIG. 2). Since the cowl 550 is a single piece, there is an opening 574 (denoted by dashed lines) to receive a fuel nozzle 306, which extends through the opening 574 towards the dome 305, the outer liner 310, and the inner liner 315 of the combustion chamber 302. The cowl 550 also has additional openings (not shown in FIG. 5) positioned circumferentially around the centerline axis 220 to receive the other fuel nozzles (not shown in FIG. 5) of the turbomachine engine.

In this example, air enters the cavity 570 through metering holes 575 on the inner (aft-facing) surface underneath the cowl 550. The air then escapes the cavity 570 through a neck 580 into the combustion chamber 302, where the air provides cooling to the inner liner 315 and likewise the outer liner 310. In other embodiments, however, the metering holes 575 may be alternatively or additionally located on the outer (forward-facing) surface of the cowl 550. Other suitable structural configurations and geometries for the cavity 570 and the neck 580 are contemplated.

The volume of the cavity 570, the length of the necks 580, and the cross-sectional area of each neck 580 can all be configured to tune the cavity 570 for damping at a specific range of frequencies. In the example of FIG. 5, the total volume V of the cavity 570 is fourteen cubic inches, the length L of the neck 580 is 0.05 inches, and the diameter of the neck is 0.03 inches. In this example, eighteen total cups (not shown in FIG. 5) are provided around the circumference of the combustor 530, and each neck 580 has multiple openings equally spaced around the circumference of the fuel nozzle 306. This layout is repeated for each of the other cups of the combustor 530. Summed over eighteen cups, the effective cross-sectional area S of the neck is 0.013 square inches. Using Equation (1), the resonant frequency for the cavity 570 is approximately two hundred seventy-seven Hz. If the diameter of the neck is widened to 0.05 inches, and all other parameters are kept the same, then, by Equation (1), the resonant frequency increases to four hundred sixty-one Hz. With similar adjustments to the parameters, the range of resonant frequencies for the cavity 570 can be varied from one hundred twenty Hz to six hundred ninety Hz, in this example. In addition, internal partitions or baffles (not shown in FIG. 5) could be used to subdivide the cavity 570 into two or more sub-cavities. The geometry of each of these sub-cavities could likewise be tuned to a different range of resonant frequencies.

Figure 6A:
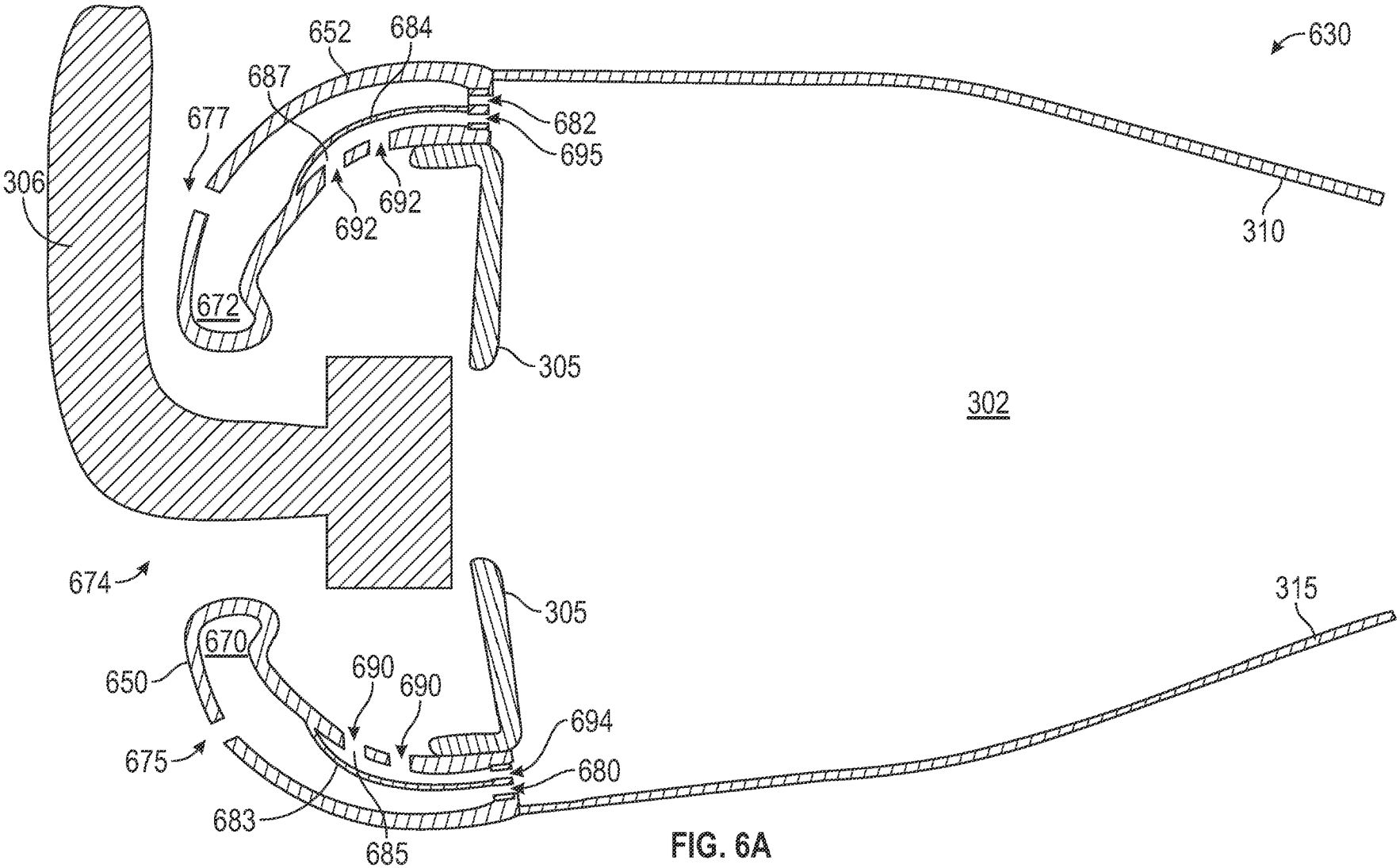
FIG. 6A shows a schematic view of a combustor of some embodiments having an inner cowl and an outer cowl, with respective inner cavities that are configured as Helmholtz resonators for acoustic damping.

FIG. 6A shows a schematic view of a combustor 630 of some embodiments having an inner cowl 650 and an outer cowl 652, with respective inner cavity 670 and outer cavity 672, that are each configured as a Helmholtz resonator for acoustic damping. This view shows a cross-sectional view through the midplane of a single cup of the combustor 630, along the axial length. The combustor 630 is similar to the embodiment of the combustor 530 discussed above with respect to FIG. 5, and like reference numerals have been used to refer to the same or similar components. A detailed description of these components will be omitted, and the following discussion focuses on the differences between these embodiments. Any of the various features discussed with any one of the embodiments discussed herein may also apply to and be used with any other embodiments.

The inner cowl 650 and the outer cowl 652 both have an annular shape that is symmetric around the centerline axis 220 (FIG. 2). The inner cowl 650 and the outer cowl 652 define a gap 674 between them, through which the fuel nozzle 306 extends towards the dome 305, the outer liner 310, and the inner liner 315 of the combustion chamber 302. The ferrule 360 and the swirler 316 have been omitted from FIG. 6A for clarity.

In the example of FIG. 6A, air enters the inner cavity 670 and outer cavity 672 through metering holes 675, 677 on the outer (forward-facing) surfaces of the inner cowl 650 and the outer cowl 652. In other embodiments, some or all of the metering holes 675, 677 may be alternatively or additionally located on the inner (aft-facing) surfaces underneath the inner cowl 650 and the outer cowl 652.

Figure 6B:
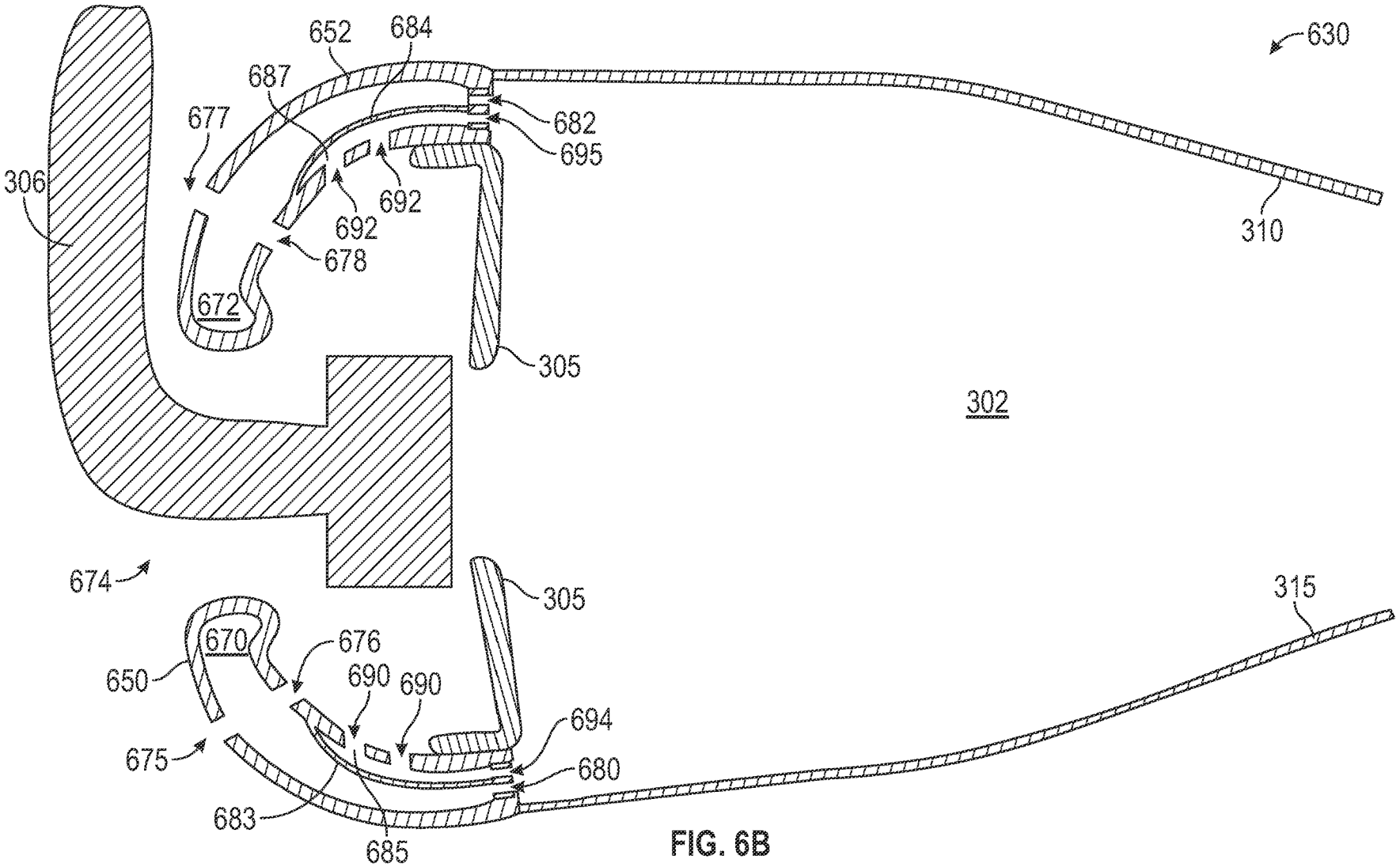
FIG. 6B shows an alternate configuration of the combustor in FIG. 6A, in which additional metering holes are provided on the inner surfaces of the cowl.

FIG. 6B shows an alternate configuration of the combustor 630 in FIG. 6A, in which additional metering holes are provided on the inner surfaces of the cowl. Specifically, metering hole 676 is located on the inner surface of the inner cowl 650 to feed the inner cavity 670, which is also fed by metering hole 675. In addition, metering hole 678 is located on the inner surface of the outer cowl 652 to feed the outer cavity 672, which is also fed by metering hole 677.

As shown in both FIG. 6A and FIG. 6B, air can escape from the inner cavity 670 and the outer cavity 672 through a corresponding inner neck 680 and an outer neck 682, into the combustion chamber 302, where the air provides cooling to the outer liner 310 and the inner liner 315. In addition, the inner cowl 650 and the outer cowl 652 each have respective internal partitions 683, 684 that define an inner cooling cavity 685 and an outer cooling cavity 687 that are adjacent to the inner cavity 670 and the outer cavity 672, respectively. The inner cooling cavity 685 and the outer cooling cavity 687 have respective intake holes 690, 692 for air to enter, and respective exit holes 694, 695 for air to exit into the combustion chamber 302. In this example, due to the position of the cooling cavities 685, 687 relative to the cavities 670, 672, the intake holes 690, 692 are located on the inner (aft) surfaces underneath the inner cowl 650 and the outer cowl 652, though the intake holes 690, 692 are not limited to these positions in other embodiments.

The volumes of the inner cavity 670 and the outer cavity 672, and the lengths and cross-sectional areas of the inner neck 680 and an outer neck 682, can be configured to tune the inner cavity 670 for damping at one specific range of frequencies, and to tune the outer cavity 672 for damping at another, different range of frequencies.

In the examples of FIG. 6A and FIG. 6B, the inner cavity 670 has a volume of 7.7 cubic inches, and the outer cavity 672 has a volume of 8 cubic inches. By varying the other parameters, in one embodiment, the inner cavity 670 cavity may be tuned in a range of one hundred eighty Hz to four hundred Hz, and the outer cavity 672 may be tuned in a range of four hundred Hz to two thousand Hz.

In addition, additional internal partitions or baffles (not shown in FIG. 6A or FIG. 6B) analogous to the internal partitions 683, 684 could also be used to subdivide either or both of the inner cavity 670 and the outer cavity 672 into two or more sub-cavities each. The geometry of each of the sub-cavities could then be likewise tuned to additional ranges of resonant frequencies.

Other suitable structural configurations than those shown in FIG. 6A and FIG. 6B are contemplated, such as fewer metering holes, additional metering holes, and providing metering holes on other surfaces of the inner cowl 650, the outer cowl 652, or both, based on the respective positions of the inner cavity 670 and the outer cavity 672.

Figure 6C:
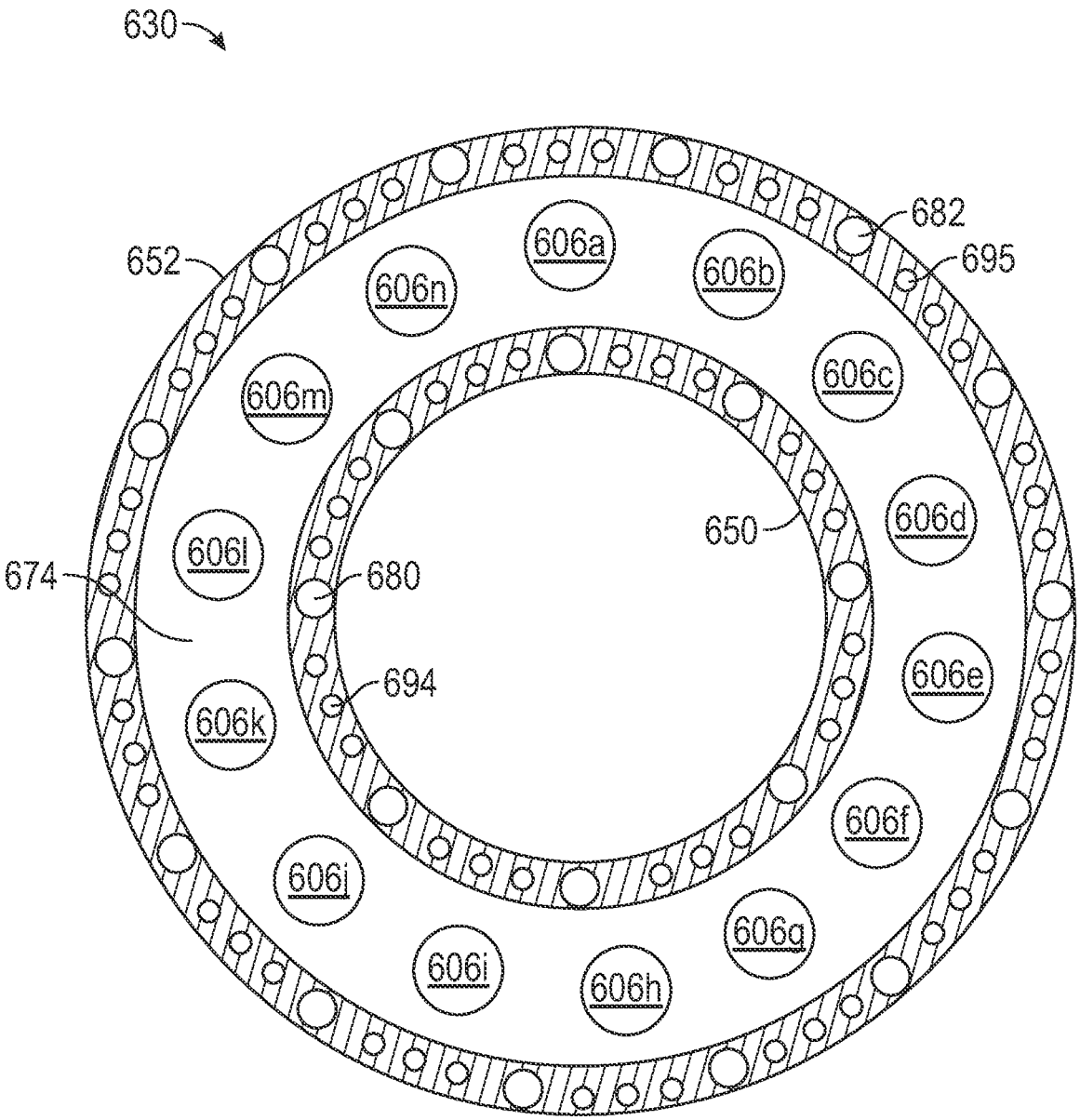
FIG. 6C shows a cross-sectional view of the combustor in FIG. 6A, taken along line 6-6 of FIG. 2, from an aft position looking forward.

FIG. 6C shows a cross-sectional view of the combustor 630, taken along line 6-6 of FIG. 2, from an aft position looking forward. The annular shapes of the inner cowl 650 and the outer cowl 652 are apparent in this view, which omits the dome and the liners for clarity. The gap 674 between the inner cowl 650 and the outer cowl 652 permits fuel nozzles 606*a* to 606*n* to extend towards the combustion chamber 302 (not shown in FIG. 6C). In this example, in both cowls, multiple neck openings (e.g., openings of inner neck 680 and outer neck 682) from multiple damping partitions are visible, alongside multiple exit holes (e.g., exit holes 694, 695) from multiple cooling partitions. For clarity in this example, all neck holes and exit holes of both the inner cowl 650 and the outer cowl 652 are shown to be circumferentially adjacent to each other in a single row, with more exit holes than neck holes. In other embodiments, however, there may be multiple radially-positioned rows of one or both types of holes, and an equal number of neck holes as exit holes, or more neck holes than exit holes, depending on the combustion dynamics and the cooling requirements of the turbomachine engine 100. The pattern of the exit holes and the neck holes, as well as their relative sizes, depends on the configuration of the damping partitions and the cooling partitions, which may be positioned circumferentially adjacent to each other (as shown in FIG. 6C), radially adjacent to each other (as shown in FIGS. 6A and 6B), or some combination of the two. These configurations may also similarly vary in single-piece cowl combustor designs like the cowl 550 of combustor 530 shown in FIG. 5.

In some embodiments, bolt holes can be used to mount the hollow cowl, with a local solid structure through the cowl. Struts likely need to be solid to provide structural integrity, for metal fasteners such as bolts, screws, pins, etc., to pass through and securely to attach the structural components.

Figure 7A:
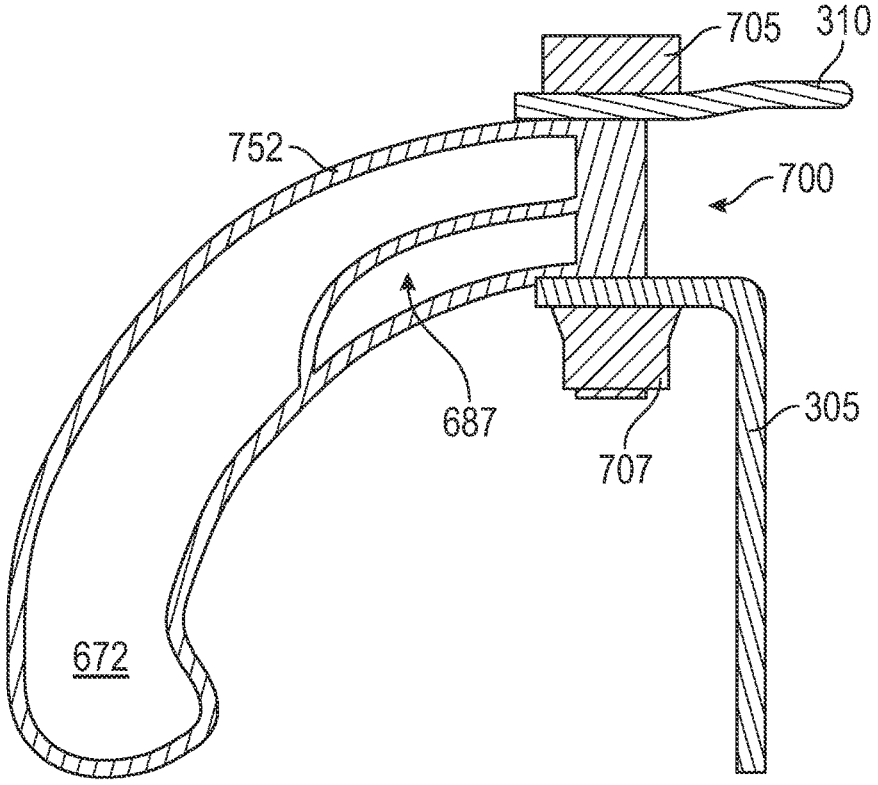
FIG. 7A shows a schematic view of a bolted joint of some embodiments, for a hollow outer cowl.
Figure 7B:
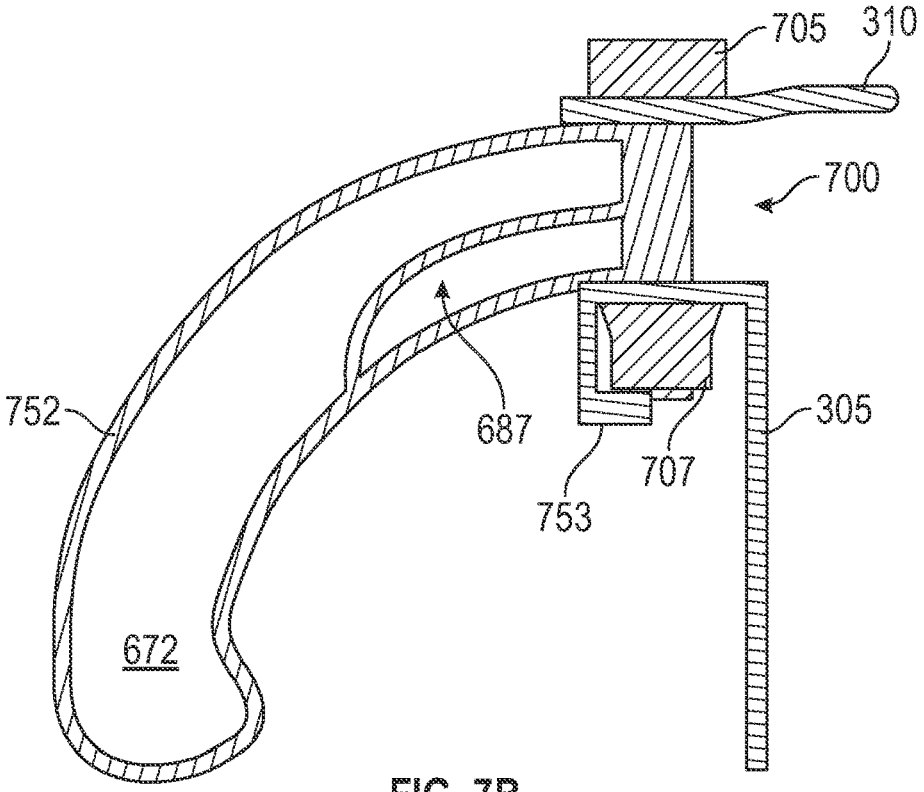
FIG. 7B shows an alternative embodiment of the bolted joint, in which the dome has a C-clip that holds a nut in place during assembly of the bolted joint.
Figure 7C:
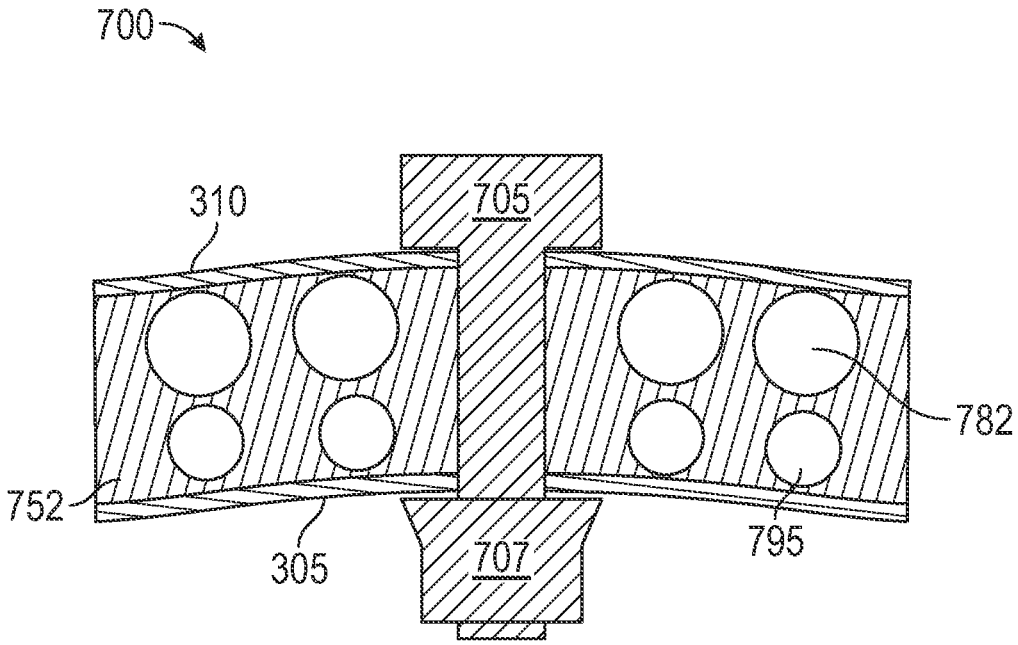
FIG. 7C shows a view of the bolted joint in FIG. 7A, from an aft position looking forward.

FIG. 7A shows a schematic view of a bolted joint 700 of some embodiments, for a hollow outer cowl 752. In this example, a bolt 705 and a nut 707 are used to secure the outer cowl 752 to the outer liner 310 and the dome 305. FIG. 7B shows an alternative embodiment of the bolted joint 700, in which the dome 305 has a C-clip 753 that holds the nut 707 in place during assembly of the bolted joint 700. In either case, the bolt 705 must pass through a substantially solid portion of the outer cowl 752 that does not have any exit holes or cooling holes. FIG. 7C shows a view of the bolted joint 700 in FIG. 7A, from an aft position looking forward. In this view, the region of the outer cowl 752 through which the bolt 705 passes is solid, and does not have any exit holes 795 (from cooling cavity 687) or neck holes 782 (from outer cavity 672). Multiple such solid portions are required along the circumference of the outer cowl 752. A similar structure is contemplated for the inner cowl 650 or a single-piece cowl 550 such as that shown in FIG. 5.

Further aspects of the present disclosure are provided by the subject matter of the following clauses.

A combustor for a turbomachine engine includes a combustion chamber, and a cowl having an annular shape that is symmetric around a centerline axis of the turbomachine engine. The cowl has a hollow cavity that is in fluid communication with the combustion chamber. The hollow cavity is a damper that reduces combustion dynamics of the combustor.

The combustor of the preceding clause, such that the hollow cavity reduces at least one of acoustic noise and mechanical vibration.

The combustor of any preceding clause, such that reducing combustion dynamics of the combustor includes at least one of reducing viscous losses and increasing heat dissipation.

The combustor of any preceding clause, such that the damper dampens combustion dynamics for at least one frequency between one hundred twenty Hertz to six hundred ninety Hertz.

The combustor of any preceding clause, such that the cowl is a unitary component with an outer radius and an inner radius, the outer radius being greater than the inner radius. The cowl includes multiple holes positioned circumferentially around the centerline axis to receive multiple fuel nozzles of the turbomachine engine.

The combustor of any preceding clause, such that the damper is an acoustic cavity. The acoustic cavity has a volume and a damper neck. The damper neck has a length and an area, and the damper neck opens into the combustion chamber. The volume, the length, and the area are configured as a Helmholtz resonator to dampen combustion dynamics for a particular frequency.

The combustor of any preceding clause, such that the damper has multiple metering holes through which air enters the acoustic cavity.

The combustor of any preceding clause, such that the hollow cavity is a first hollow cavity. The cowl also includes a second hollow cavity that is in fluid communication with the combustion chamber. The second hollow cavity is a cooling cavity, having multiple intake holes for air to enter the cooling cavity and multiple exit holes for air to exit from the cooling cavity into the combustion chamber.

The combustor of any preceding clause, such that the acoustic cavity and the cooling cavity are adjacent to one another and are separated by a shared partition.

The combustor of any preceding clause, such that the hollow cavity is a first hollow cavity, the damper is a first damper, the acoustic cavity is a first acoustic cavity, and the particular frequency is a first frequency. The cowl also includes a second hollow cavity that is in fluid communication with the combustion chamber. The second hollow cavity is a second damper that reduces combustion dynamics of the combustor. The second damper is a second acoustic cavity that is configured to dampen combustion dynamics for a second frequency.

The combustor of any preceding clause, such that the volume is a first volume, the damper neck is a first damper neck, the length is a first length, the area is a first area, and the Helmholtz resonator is a first Helmholtz resonator, such that the second acoustic cavity has a second volume, a second damper neck with a second length and a second area, the second damper neck opening into the combustion chamber of the combustor, and such that the second volume, the second length, and the second area are configured as a second Helmholtz resonator to dampen combustion dynamics for the second frequency.

The combustor of any preceding clause, such that the cowl includes an outer component and an inner component, the outer component being annular in shape with a first radius around the centerline axis of the turbomachine engine, the inner component being annular in shape with a second radius around the centerline axis of the turbomachine engine, the second radius being smaller than the first radius to define a gap between the outer component and the inner component, and such that the gap is configured to receive multiple fuel nozzles of the turbomachine engine.

The combustor of any preceding clause, such that the hollow cavity is a first hollow cavity in the outer component, the damper being an outer damper, and such that the cowl includes a second hollow cavity in the inner component, the second hollow cavity being configured as an inner damper to reduce combustion dynamics of the combustor.

The combustor of any preceding clause, such that the outer damper is configured to dampen combustion dynamics for a first frequency, and the inner damper is configured to dampen combustion dynamics for a second frequency that is different from the first frequency.

The combustor of any preceding clause, such that the first frequency is between one hundred eighty Hertz and four hundred Hertz.

The combustor of any preceding clause, such that the second frequency is between four hundred Hertz and two thousand Hertz.

The combustor of any preceding clause, further including a dome positioned aft of the cowl and defining a first, forward boundary of the combustion chamber. The combustor further includes a liner forming a second, circumferential boundary of the combustion chamber, such that multiple fasteners secure the dome, the liner, and a portion of the cowl therebetween.

The combustor of any preceding clause, such that the cowl includes multiple solid portions proximate to the liner and the dome. The fasteners pass through the solid portion of the cowl.

Although the foregoing description is directed to the preferred embodiments, other variations and modifications will be apparent to those skilled in the art, and may be made without departing from the spirit or scope of the disclosure Moreover, features described in connection with one embodiment may be used in conjunction with other embodiments, even if not explicitly stated above.

The invention claimed is:

1. A combustor for a turbomachine engine, the combustor comprising:

a combustion chamber in which fuel and air are combusted to generate combustion gases, the generating of the combustion gases creating combustion dynamics in the combustion chamber;

a fuel nozzle feeding the fuel to the combustion chamber;

a dome having an outer wall and an inner wall, the dome at least partially defining the combustion chamber; and a cowl coupled directly to the outer wall and the inner wall of the dome, the cowl including a wall, the wall of the cowl being hollow and having an arcuate, annular shape that is symmetric around a centerline axis of the turbomachine engine, the cowl comprising a hollow cavity embedded within the wall of the cowl, the hollow cavity being in fluid communication with the combustion chamber to provide the air to the combustion chamber, a volume of the hollow cavity being configured such that the hollow cavity resonates at a frequency that damps the combustion dynamics in the combustion chamber so that the hollow cavity is a damper that reduces the combustion dynamics in the combustion chamber.

2. The combustor of claim 1, wherein reducing combustion dynamics of the combustor comprises at least one of reducing viscous losses and increasing heat dissipation.

3. The combustor of claim 1, wherein the damper damps combustion dynamics for at least one frequency between one hundred twenty Hertz to six hundred ninety Hertz.

4. The combustor of claim 1, wherein the cowl is a unitary component with an outer radius and an inner radius, the outer radius being greater than the inner radius, and wherein the cowl comprises a plurality of holes positioned circumferentially around the centerline axis to receive a plurality of fuel nozzles of the turbomachine engine.

5. The combustor of claim 1, wherein the hollow cavity includes a first hollow cavity configured as an acoustic cavity that is a Helmholtz resonator and a second hollow cavity configured as a cooling cavity, the second hollow cavity being in fluid communication with the combustion chamber and having a plurality of intake holes for air to enter into the cooling cavity and a plurality of exit holes for air to exit from the cooling cavity into the combustion chamber.

6. The combustor of claim 5, wherein the acoustic cavity and the cooling cavity are adjacent to one another and are separated by a shared partition.

7. The combustor of claim 1, wherein the cowl comprises an outer component and an inner component, the outer component being annular in shape with a first radius around the centerline axis of the turbomachine engine, the inner component being annular in shape with a second radius around the centerline axis of the turbomachine engine, the second radius being smaller than the first radius to define a gap between the outer component and the inner component, and wherein the gap is configured to receive a plurality of fuel nozzles of the turbomachine engine.

8. The combustor of claim 7, wherein the hollow cavity is a first hollow cavity in the outer component, the damper being an outer damper, and wherein the cowl comprises a second hollow cavity in the inner component, the second hollow cavity being configured as an inner damper to reduce combustion dynamics of the combustor.

9. The combustor of claim 8, wherein the outer damper is configured to damp combustion dynamics for a first frequency, and the inner damper is configured to damp combustion dynamics for a second frequency that is different from the first frequency.

10. The combustor of claim 9, wherein the first frequency is between one hundred eighty Hertz and four hundred Hertz.

11. The combustor of claim 9, wherein the second frequency is between four hundred Hertz and two thousand Hertz.

12. The combustor of claim 1, further comprising an inner liner and an outer liner forming a circumferential boundary of the combustion chamber, wherein a plurality of fasteners secure the dome, the inner liner and the outer liner, and a portion of the cowl therebetween, and the dome is positioned aft of the cowl and defines a forward boundary of the combustion chamber.

13. The combustor of claim 12, wherein the cowl comprises a plurality of solid portions proximate to the inner liner or the outer liner and the dome, wherein the fasteners pass through the plurality of solid portions of the cowl.

14. The combustor of claim 1, further comprising an inner liner and an outer liner together forming a circumferential boundary of the combustion chamber, wherein the hollow cavity includes a damper neck that is partially forward or entirely forward of the inner liner or the outer liner, the damper neck directing (i) cooling air from the hollow cavity into the combustion chamber so that the cooling air cools the outer liner or the inner liner and (ii) acoustics of the combustion chamber into the hollow cavity such that the hollow cavity reduces at least one of acoustic noise and mechanical vibration.

15. The combustor of claim 14, wherein the hollow cavity is an acoustic cavity configured as a Helmholtz resonator to damp combustion dynamics for a particular frequency.

16. The combustor of claim 15, wherein the damper has a plurality of metering holes through which air enters the acoustic cavity.

17. The combustor of claim 15, wherein the hollow cavity includes a first hollow cavity configured as a first acoustic cavity and a first damper damping the combustion dynamics at a first frequency, and wherein the hollow cavity includes a second hollow cavity configured as a second acoustic cavity and a second damper damping the combustion dynamics at a second frequency.

18. The combustor of claim 17, wherein the first frequency is between one hundred eighty Hertz and four hundred Hertz.

19. The combustor of claim 17, wherein the second frequency is between four hundred Hertz and two thousand Hertz.

20. The combustor of claim 17, wherein the first acoustic cavity includes a first damper neck opening into the combustion chamber of the combustor, and is configured as a first the Helmholtz resonator to damp the combustion dynamics at the first frequency, and wherein the second acoustic cavity has a second damper neck opening into the combustion chamber of the combustor, and is configured as a second the Helmholtz resonator to damp the combustion dynamics at the second frequency.

* * * * *